US009765511B2

(12) United States Patent
Inoue et al.

(10) Patent No.: US 9,765,511 B2
(45) Date of Patent: Sep. 19, 2017

(54) FACTORY BUILDING ASSEMBLY STRUCTURE AND METHOD FOR ASSEMBLING FACTORY BUILDING USING THE SAME

(75) Inventors: Tadashi Inoue, Kawasaki (JP); Hisao Nakajima, Kitakyushu (JP)

(73) Assignee: Taikisha Ltd., Tokyo (JP)

( * ) Notice: Subject to any disclaimer, the term of this patent is extended or adjusted under 35 U.S.C. 154(b) by 828 days.

(21) Appl. No.: 12/937,629

(22) PCT Filed: Dec. 7, 2009

(86) PCT No.: PCT/JP2009/070465
§ 371 (c)(1),
(2), (4) Date: Jan. 3, 2011

(87) PCT Pub. No.: WO2010/073896
PCT Pub. Date: Jul. 1, 2010

(65) Prior Publication Data

US 2011/0107712 A1 May 12, 2011

(30) Foreign Application Priority Data

Dec. 25, 2008 (JP) ..... 2008-330743
Nov. 19, 2009 (JP) ..... 2009-264270

(51) Int. Cl.
*E04B 1/19* (2006.01)
*E04B 1/18* (2006.01)
(Continued)

(52) U.S. Cl.
CPC ..... *E04B 1/18* (2013.01); *E04B 1/08* (2013.01); *E04B 1/6141* (2013.01); *E04B 2001/2481* (2013.01); *E04B 2001/2487* (2013.01)

(58) Field of Classification Search
CPC . E04B 1/08; E04B 1/18; E04B 1/6141; E04B 2001/2481; E04B 2001/2487
(Continued)

(56) References Cited

U.S. PATENT DOCUMENTS 3,978,629 A * 9/1976 Echols, Sr. ..... 52/235
4,083,157 A * 4/1978 Anthonioz ..... 52/222
(Continued)

FOREIGN PATENT DOCUMENTS

GB 1602892 11/1981
JP 52107113 9/1977
(Continued)

*Primary Examiner* — Elizabeth A Quast
(74) *Attorney, Agent, or Firm* — The Webb Law Firm

(57) ABSTRACT

A framing member forming a frame of a factory building is provided with a slit for attaching a holder on one side face of the framing member, the slit extending in a longitudinal direction of the framing member, the slit is provided with a detachment prevention mechanism configured to exert an action of preventing an insertion piece of the holder from being detached and to fix the holder to the framing member, along with an insertion of the insertion piece into the slit, and the holder is provided with a pinching piece configured to pinch an end edge portion of a wall panel between the pinching piece and the framing member to fix the wall panel to the framing member, along with the insertion of the insertion piece into the slit.

10 Claims, 14 Drawing Sheets

(51) Int. Cl.
*E04B 1/08* (2006.01)
*E04B 1/61* (2006.01)
*E04B 1/24* (2006.01)

(58) Field of Classification Search
USPC ..... 52/235, 36.1, 782.1, 802.11, 718.04, 52/718.06, 222, 239, 459, 460, 463, 468, 52/469, 470, 471; 12/235, 36.1, 782.1, 12/802.11, 718.04, 718.06
See application file for complete search history.

(56) References Cited

U.S. PATENT DOCUMENTS

| | | | | |
|---|---|---|---|---|
| 4,117,640 | A * | 10/1978 | Vanderstar | 52/204.593 |
| 4,385,850 | A * | 5/1983 | Bobath | 403/205 |
| 4,689,930 | A * | 9/1987 | Menchetti | 52/277 |
| 4,876,835 | A * | 10/1989 | Kelley et al. | 52/239 |
| 4,937,959 | A * | 7/1990 | Palmer et al. | 40/793 |
| 5,029,422 | A * | 7/1991 | Scherrer | 52/222 |
| 5,058,340 | A * | 10/1991 | Muller | 52/222 |
| 5,070,667 | A * | 12/1991 | Schulte | 52/241 |
| 5,243,800 | A * | 9/1993 | Olbrich | 52/287.1 |
| 5,253,459 | A * | 10/1993 | Parinas et al. | 52/235 |
| 5,438,778 | A * | 8/1995 | Komamura | 40/783 |
| 5,481,839 | A * | 1/1996 | Lang et al. | 52/235 |
| 5,687,524 | A * | 11/1997 | Ting | 52/461 |
| 5,899,035 | A * | 5/1999 | Waalkes et al. | 52/239 |
| 6,260,321 | B1 * | 7/2001 | Rudduck | 52/474 |
| 6,289,646 | B1 * | 9/2001 | Watanabe | 52/506.01 |
| 6,341,457 | B1 * | 1/2002 | Aerts et al. | 52/239 |
| 6,442,909 | B2 * | 9/2002 | Waalkes et al. | 52/239 |
| 6,729,085 | B2 * | 5/2004 | Newhouse et al. | 52/239 |
| 6,745,527 | B1 * | 6/2004 | Sherman et al. | 52/235 |
| 6,804,920 | B2 * | 10/2004 | Hogan | 52/235 |
| 7,162,842 | B2 * | 1/2007 | Ribic | 52/235 |
| 7,168,213 | B2 * | 1/2007 | Rudduck et al. | 52/235 |
| 7,562,504 | B2 * | 7/2009 | Herbst et al. | 52/461 |
| 7,562,509 | B2 * | 7/2009 | Ness | 52/800.11 |
| 7,565,772 | B2 * | 7/2009 | Waalkes et al. | 52/36.1 |
| 2001/0013209 | A1 * | 8/2001 | Waalkes et al. | 52/239 |
| 2002/0069601 | A1 * | 6/2002 | Hodges et al. | 52/481.2 |
| 2002/0124514 | A1 * | 9/2002 | Higgins | 52/506.06 |
| 2002/0170239 | A1 * | 11/2002 | Marrotte et al. | 52/36.1 |
| 2003/0205009 | A1 * | 11/2003 | Herbst et al. | 52/235 |
| 2003/0226324 | A1 * | 12/2003 | Hogan | 52/235 |
| 2004/0154233 | A1 * | 8/2004 | Hodges et al. | 52/36.1 |
| 2004/0177573 | A1 * | 9/2004 | Newhouse et al. | 52/239 |
| 2005/0144855 | A1 * | 7/2005 | Waalkes et al. | 52/36.1 |
| 2006/0196147 | A1 * | 9/2006 | Dickey | 52/782.1 |
| 2009/0313935 | A1 * | 12/2009 | Montgomery | 52/506.1 |
| 2010/0300021 | A1 * | 12/2010 | Falk | 52/235 |
| 2011/0061320 | A1 * | 3/2011 | Scherrer | 52/222 |
| 2013/0149489 | A1 * | 6/2013 | Schmidt et al. | 428/100 |
| 2013/0180190 | A1 * | 7/2013 | Bovet et al. | 52/220.1 |

FOREIGN PATENT DOCUMENTS

| | | | |
|---|---|---|---|
| JP | 54131309 | A | 10/1979 |
| JP | 5529605 | U | 2/1980 |
| JP | 56174624 | | 12/1981 |
| JP | 6371312 | U | 5/1988 |
| JP | 1148361 | A | 6/1989 |
| JP | 6121948 | A | 5/1994 |
| JP | 7109772 | A | 4/1995 |
| JP | 7324498 | A | 12/1995 |
| JP | 8260730 | A | 10/1996 |
| JP | 11159164 | A | 6/1999 |
| JP | 2005113456 | A | 4/2005 |
| JP | 2005240381 | A | 9/2005 |
| JP | 2008174909 | A | 7/2008 |
| WO | 8600948 | A1 | 2/1986 |
| WO | 0165920 | A1 | 9/2001 |

* cited by examiner

FACTORY BUILDING ASSEMBLY STRUCTURE AND METHOD FOR ASSEMBLING FACTORY BUILDING USING THE SAME

BACKGROUND OF THE INVENTION

Field of the Invention

The present invention relates to a factory building assembly structure used for constructing a factory building for various applications, and a method for assembling a factory building using the assembly structure.

The present invention particularly relates to the factory building assembly structure suitable for constructing a tunnel-shaped factory building enclosing a production line, such as paint booth, and the method for assembling a factory building using the assembly structure.

Description of the Related Art

Conventionally, a paint booth, for example, has been constructed in the following manner.

As shown in FIG. 19, framing members 4 made of mold steel to be used as building frame member, such as post and beam, are welded to form a shrine gate-shaped building frame M.

A plurality of the building frames M are parallelly erected at a construction site of the factory building. On the framing members 4 of the erected building frames M, bent wall panels 6 are mounted using bolt coupling or welding in such a manner that the bent wall panel 6 bridges the framing members 4.

As shown in FIG. 20, an end edge portion 6*a* of the bent wall panel 6 is processed to be bent. By mounting the bent wall panels 6, a side wall and a ceiling wall are provided.

Then, a finish treatment is performed, such as caulking treatment of a gap present in a connecting portion between members, using a sealing member C. (No document has been found that shows this prior art.)

However in the conventional method, artisans of welding or the like are required. In addition, a large amount of time and effort is required for welding adjustment and bolt coupling of many portions. As a result, problems arise that the cost for factory building as well as the number of days for construction becomes larger.

Since the factory building is assembled by welding or bolt coupling at the construction site, many welding traces and bolt end portions are exposed in various portions of the factory building. In addition, caulking traces of the sealing member are also exposed. From this viewpoint, there has been a room for improvement in design.

SUMMARY OF THE INVENTION

In view of the above, one object of the present invention is to provide a factory building assembly structure and a method for assembling a factory building that can effectively solve the above-described problems of the prior art.

A first aspect of the present invention relates to a factory building assembly structure, whose feature is that a framing member forming a frame of a factory building is provided with a slit for attaching a holder on one side face of the framing member, the slit extending in a longitudinal direction of the framing member, the slit is provided with a detachment prevention mechanism configured to exert an action of preventing an insertion piece of the holder from being detached and to fix the holder to the framing member, along with an insertion of the insertion piece into the slit, and the holder is provided with a pinching piece configured to pinch an end edge portion of a wall panel between the pinching piece and the framing member to fix the wall panel to the framing member, along with the insertion of the insertion piece into the slit.

With this configuration, by simply inserting the insertion piece of the holder into the slit in one side face of the framing member, the holder can be fixed to the framing member along with the insertion, due to the detachment prevention mechanism.

Along therewith, a pinching action of the pinching piece of the holder is exerted on the end edge portion of the wall panel positioned on one side face of the framing member, so as to bring the pinching piece into contact with the wall panel by pressurizing from an opposite side to the framing member, and with this configuration, by pinching a panel end edge portion between the pinching piece and the framing member, the wall panel can be fixed to the framing member.

In other words, the wall panel can be fixed by only an operation of the holder, and thus as compared with the conventional method, the working steps can be reduced and an assembly operation can be facilitated.

In addition, since the fixation is by pinching, a panel material prepared by simple cutting can be used as a wall panel. Therefore, the use of the bent wall panel that requires the bending processing of the end edge portion as described above can be omitted.

From the above, the cost for factory building can be reduced, and at the same time, the number of days for construction can be reduced.

Further, the insertion piece and pinching piece of the holder can be in a shape that surrounds the end edge portion of the wall panel. Therefore, it is not necessary to apply caulking treatment as finish treatment to a joint region between the end edge portion of the wall panel and the framing member. Also from this viewpoint, the cost for factory building can be reduced, and at the same time, the number of days for construction can be reduced.

Moreover, due to the panel fixation using the holder as described above, exposed portions, such as bolt end portions, welding traces, and caulking traces, can be reduced. As a result, the design can be improved.

It should be noted that, with respect to the slit for attaching the holder provided in one side face of the framing member, the slit may be directly formed in one side face of the framing member by cutting or making a hole.

Alternatively, the slit for attaching a holder may be provided by attaching a slit-forming member to one side face of the framing member.

For the slit for attaching a holder that extends in a longitudinal direction of the framing member, the slit may be provided contiguously along the entire length of the framing member.

Alternatively, the slit may be provided intermittently in the longitudinal direction of the framing member.

The cross section of the framing member is not limited to a rectangle, and the cross section of the framing member may be a circle or an ellipse.

For the structure of the holder, various structures may be adopted, such as a structure having an L-shaped section with one side of the L-shape serving as an insertion piece and other side of the L-shape serving as a pinching piece.

In addition, the holder may have a structure having a T-shaped section with a pinching piece and an auxiliary piece extending from the base end portion of the insertion piece, the auxiliary piece extending in an opposite direction to that of the pinching piece.

The detachment prevention mechanism may be of any type that can prevent detachment. The detachment prevention mechanism may have a function of automatically exerting an action of preventing the insertion piece of the holder from being detached, along with the insertion of the insertion piece into the slit, and in addition, such detachment prevention may be cancelable.

A second aspect of the present invention specifies an embodiment preferred for carrying out the first aspect, whose feature is that the detachment prevention mechanism includes: a detachment prevention engaging portion provided on the insertion piece of the holder; and a detachment prevention engaged portion provided on the framing member, which is configured to prevent the insertion piece of the holder from being detached, by being engaged with the detachment prevention engaging portion along with an insertion of the insertion piece into the slit.

With this configuration, a detachment prevention mechanism can be obtained simply by providing the detachment prevention engaging portion and the detachment prevention engaged portion to the insertion piece of the holder and the framing member, respectively, such as hook engagement type mechanism and recess-protrusion engagement type mechanism, that can be engaged with each other along with the insertion of the holder insertion piece into the slit. Therefore, also from this point of view, the cost for factory building can be reduced.

A third aspect of the present invention specifies an embodiment preferred for carrying out the first or second aspect, whose feature is that the end edge portion of the wall panel is pinched between a panel receiving face of the framing member configured to receive the end edge portion of the wall panel and the pinching piece of the holder, while a sealing member is present between the end edge portion of the wall panel and the panel receiving face.

With this configuration, due to the sealing member present between the end edge portion of the wall panel and the panel receiving face of the framing member as described above, airtightness of the joint region between the wall panel and the framing member can be enhanced. Therefore, as described above, together with the surrounding of the end edge portion of the wall panel by the insertion piece and pinching piece of the holder, airtightness of the factory building can be further enhanced.

A fourth aspect of the present invention specifies an embodiment preferred for carrying out any one of the first to third aspects, whose feature is that the holder is provided with two ridges of the insertion pieces arranged in parallel, and the slit has an opening width that allows simultaneous insertion of two ridges of the insertion piece of the holder.

With this configuration, by utilizing elastic deformation in approaching-separating directions (in other words, elastic deformation in a direction of an opening width of the slit) of the two ridges of the insertion pieces provided in the holder, the fixation of the holder and the wall panel to the framing member, by inserting the two ridges of the insertion piece into the slit, can be facilitated. Moreover, the fixation strength can be enhanced.

It should be noted that the two ridges of the insertion pieces may have exactly the same structure, or may have some differences in the structure.

A fifth aspect of the present invention specifies an embodiment preferred for carrying out any one of the first to fourth aspects, whose feature is that C type steel is used as the framing member and an opening in a C-shaped section of the C type steel is used as the slit.

With this configuration, the opening in the C-shaped section of the C type steel is utilized as the slit, and therefore time and effort required for post-processing can be omitted as compared with the case where the slit is formed by post-processing in the steel to be used as a framing member. As a result, the cost for factory building can be further reduced.

A sixth aspect of the present invention specifies an embodiment preferred for carrying out any one of the first to fifth aspects, whose feature is that the holder is a bent member formed by bending processing so as to have the insertion piece and the pinching piece as bent portions.

With this configuration, the number of members can be reduced and the formation of the holder is facilitated, as compared with the case where a member forming the insertion piece and a member forming the pinching piece are separately provided and the holder is formed by assembling coupling of these members. As a result, the cost for factory building can be still further reduced.

A seventh aspect of the present invention specifies an embodiment preferred for carrying out any one of the first to sixth aspects, whose feature is that two pinching pieces are arranged on both sides of the insertion piece of the holder, and these two pinching pieces are configured to fix the respective wall panels to the framing member.

With this configuration, only a single holder is used for pinching two wall panels and fixing these panels to the framing members. As a result, the number of the required holder can be reduced.

Accordingly, the working steps for fixing the holder can be reduced, and the construction of factory building is further facilitated. In addition, the cost for factory building can be yet further reduced.

It should be noted that, if desired, only one of the two pinching pieces may be used for pinching and fixing the wall panel.

An eighth aspect of the present invention specifies an embodiment preferred for carrying out any one of the first to seventh aspects, whose feature is that a coupling mechanism is provided that is configured to closely connect the two framing members, by exerting a connection action as the framing members are moved relatively toward each other along a predetermined approaching pathway while retaining a state in which outer faces of the framing members are opposed to each other so that the wall panels mounted on the framing members extend in opposite directions from the framing members.

With this configuration, by simply moving relatively toward each other along a predetermined approaching pathway while retaining a state in which outer faces of the two framing members are opposed to each other, the two framing members can be closely connected together through the above-described coupling mechanism, while retaining a state in which the outer faces of the two framing members are opposed to each other.

Therefore, in a factory building construction where such a connection of the framing members is required, the working steps can be further efficiently reduced and at the same time the assembly operation can be facilitated.

In addition, by connecting the framing members through the coupling mechanism as described above, exposed portions, such as bolt end portions and welding traces, can be further reduced. Therefore, the design can be further improved.

It should be noted that the coupling mechanism may be of any type.

The coupling mechanism may have a function of automatically exerting a connecting action through a relative approaching movement of the two framing members along a predetermined approaching pathway, and in addition, such a connection may be cancelable.

A ninth aspect of the present invention specifies an embodiment of the eighth aspect, whose feature is that the coupling mechanism includes: a coupling engaging portion provided on one of the two framing members; and a coupling engaged portion provided on the other of the two framing members, which is configured to be engaged with the coupling engaging portion to closely connect the two framing members in a state in which outer faces of the two framing members are opposed to each other, as the two framing members are moved relatively toward each other along a predetermined approaching pathway while retaining a state in which outer faces of the two framing members are opposed to each other.

With this configuration, a coupling mechanism can be obtained simply by providing the coupling engaging portion and the coupling engaged portion to the two framing members, such as hook engagement type mechanism and recess-protrusion engagement type mechanism, that can be engaged with each other as the two framing members are moved relatively toward each other along a predetermined approaching pathway. Therefore, the cost for factory building can be still further reduced.

A tenth aspect of the present invention specifies an embodiment preferred for carrying out the eighth or ninth aspect, whose feature is that at least one of the two framing members is provided with a guide member configured to guide a relative approaching movement along a predetermined approaching pathway of the two framing members.

With this configuration, a relative approaching movement along a predetermined approaching pathway of the two framing members can be further accurately and smoothly performed with the guide by the guide member. As a result, the assembly operation of factory building becomes further facilitated.

An eleventh aspect of the present invention relates to a method for assembling a factory building using the factory building assembly structure according to any one of the eighth to tenth aspects, whose feature is that the method include: a step of forming a wall structure, in which the wall panel is fixed to two framing members arranged in parallel in a front-rear direction using the holder in such a manner that the wall panel bridges the two framing members;

a step of forming a gate-shaped module, in which a transversal wall structure is connected to a pair of right and left upright wall structures in such a manner that the transversal wall structure bridges the right and left upright wall structures; and a step of constructing the factory building by connecting a plurality of the gate-shaped modules arranged in the front-rear direction, in which with respect two gate-shaped modules arranged adjacently in the front-rear direction, the framing member on a rear side in the gate-shaped module on a front side and the framing member on the front side in the gate-shaped module on the rear side are connected with each other by the coupling mechanism.

With this configuration, by simply moving the front and rear gate-shaped modules relatively toward each other along a predetermined approaching pathway so that the rear framing member of the front gate-shaped module and the front framing member of the rear gate-shaped module approach to each other, these front and rear gate-shaped modules can be easily connected through the connection of framing members with each other by the coupling mechanism.

Therefore, by repeating the coupling operation to connect a plurality of the gate-shaped modules arranged in a front-rear direction, the factory building made of the connected gate-shaped modules can be easily constructed at a low cost.

In addition, due to the panel fixation using the holder and the framing member coupling using the coupling mechanism as described above, exposed portions, such as bolt end portions and welding traces, can be reduced. Therefore, a factory building with further excellent design can be constructed.

DETAILED DESCRIPTION OF THE INVENTION

First Embodiment

Figure 1:
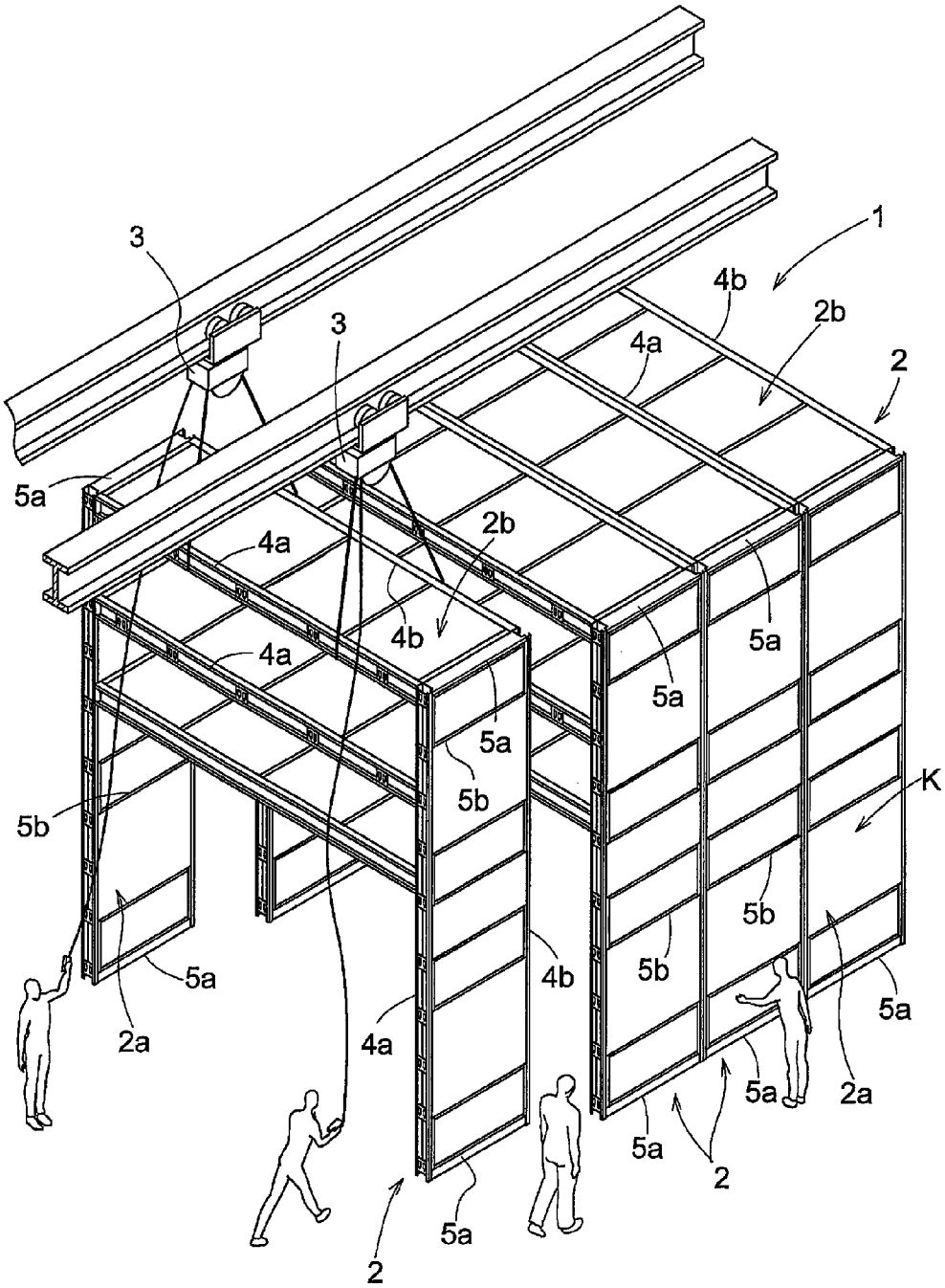
FIG. 1 is a perspective view showing a paint booth assembling process in a first embodiment.

FIG. 1 shows an assembling process of a paint booth 1 in a paint factory (one example of a factory building). For assembling the paint booth 1, a plurality of gate-shaped modules 2 which are erected are arranged in a front-rear direction by sequentially conveying them using overhead traveling cranes 3 or the like, as shown in FIG. 1. Then, the adjacent gate-shaped modules 2 standing upright are coupled to form the paint booth 1.

The gate-shaped module 2 is formed of a pair of right and left upright wall structures K as right and left side walls 2*a*, and a transversal wall structure K as a ceiling wall 2*b* that bridges the right and left wall structures K.

Figure 2:
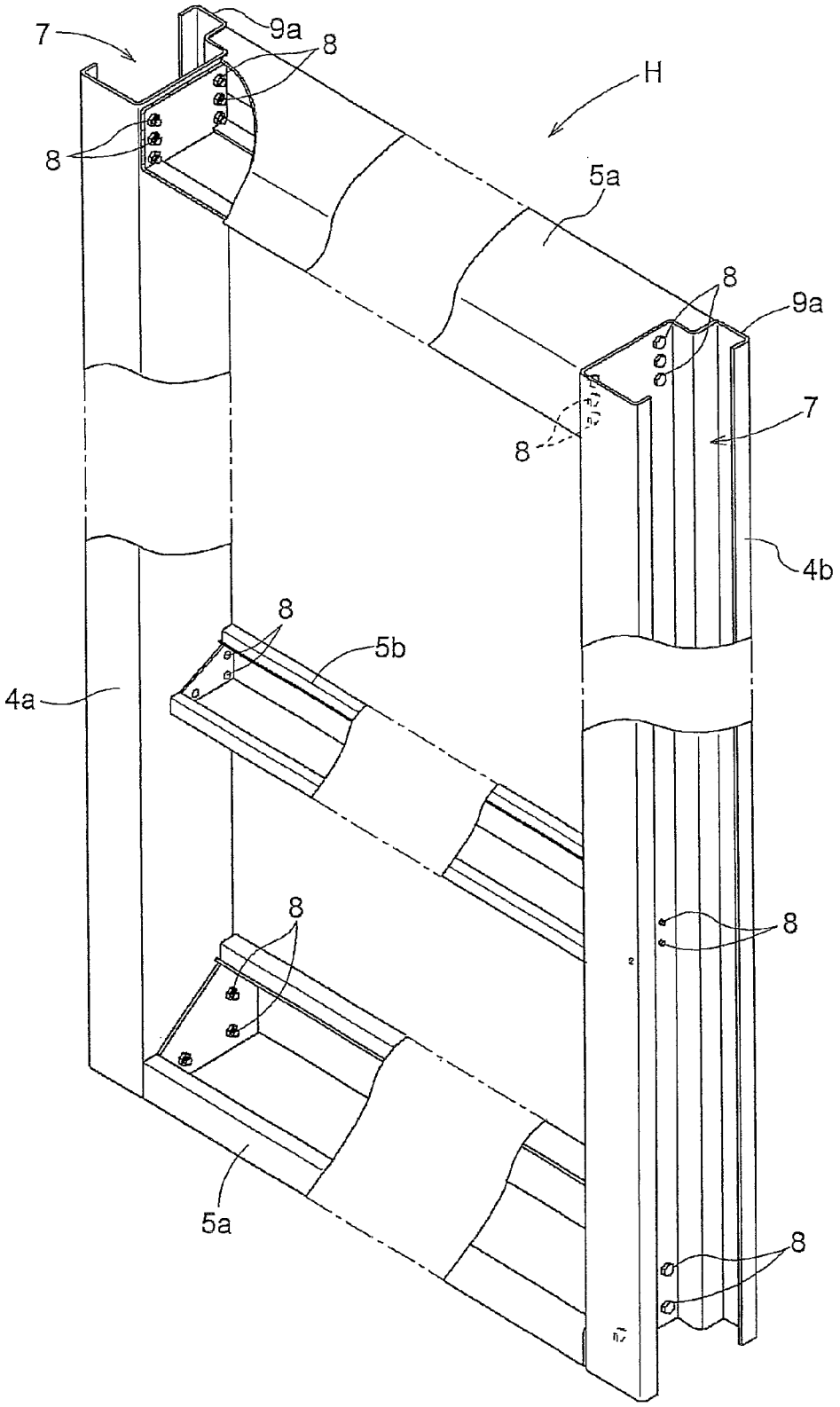
FIG. 2 is a partially omitted perspective view showing a frame structure in the first embodiment.
Figure 3:
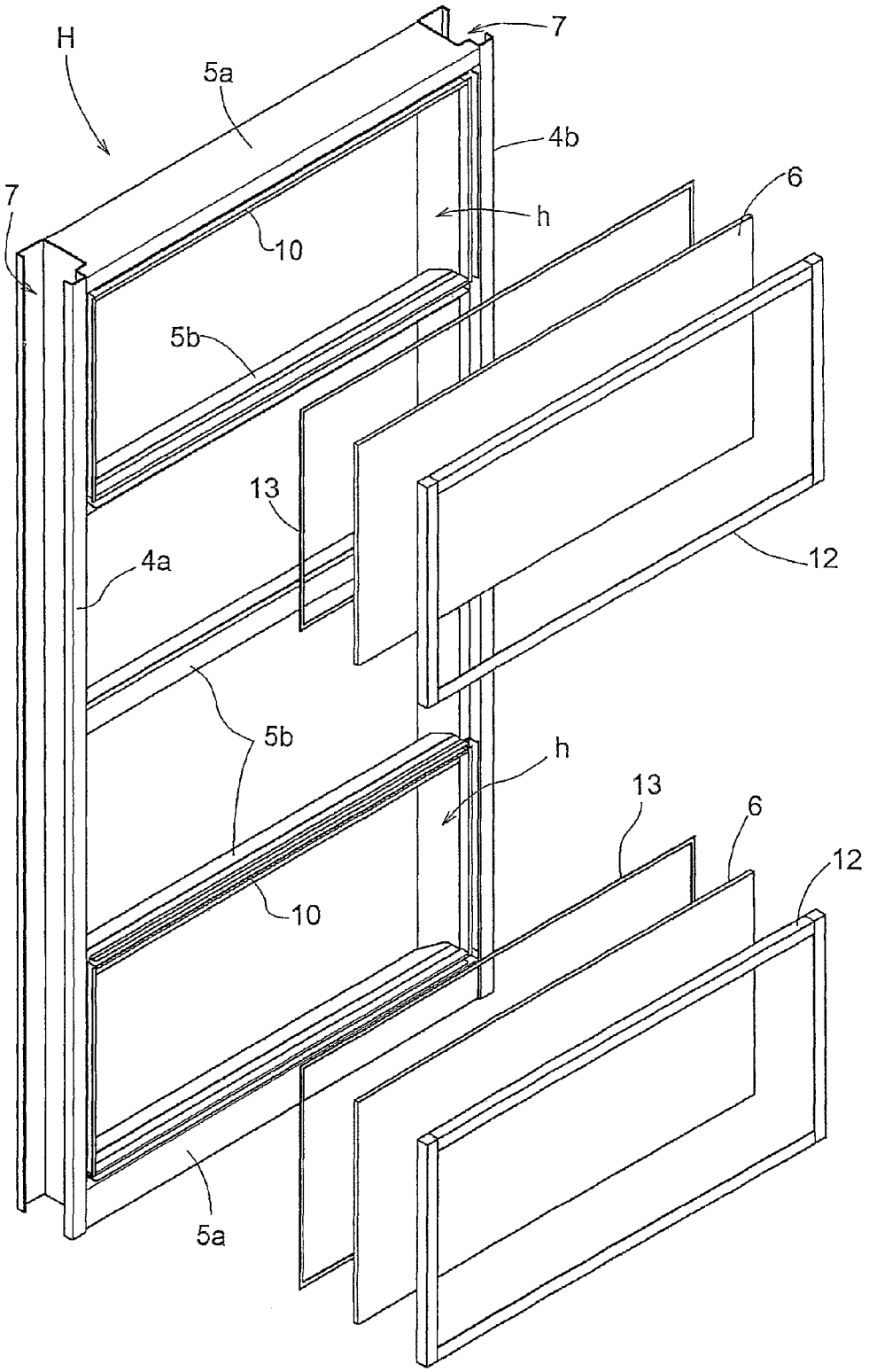
FIG. 3 is an exploded perspective view showing a wall panel mounting structure in the first embodiment.

As shown in FIGS. 1-3, each of the wall structures K serving as the side walls 2*a* and ceiling wall 2*b* includes a ladder-like frame structure H formed by connecting two front and rear main framing members 4*a* and 4*b* (corresponding to the "framing member" according to a first feature of the present invention) arranged in parallel, through bridging framing members 5*a* and reinforcing framing members 5*b*.

In the wall structure K, wall panels 6 are mounted and fixed to the two main framing members 4*a* and 4*b* of the frame structure H in such a manner that the wall panel 6 bridges the main framing members 4*a* and 4*b*.

For each of the framing members 4*a*,4*b*,5*a*,5*b* forming the ladder-like frame structure H, a mold steel is used which has a C-shaped section or squared U-shaped section with an opening 7 on one side as a sectional view.

The main framing members 4*a* and 4*b* are connected with the bridging framing member 5*a* as well as the reinforcing framing member 5*b*, through bolts 8 provided inside the C-shaped section or squared U-shaped section.

Figure 4A:
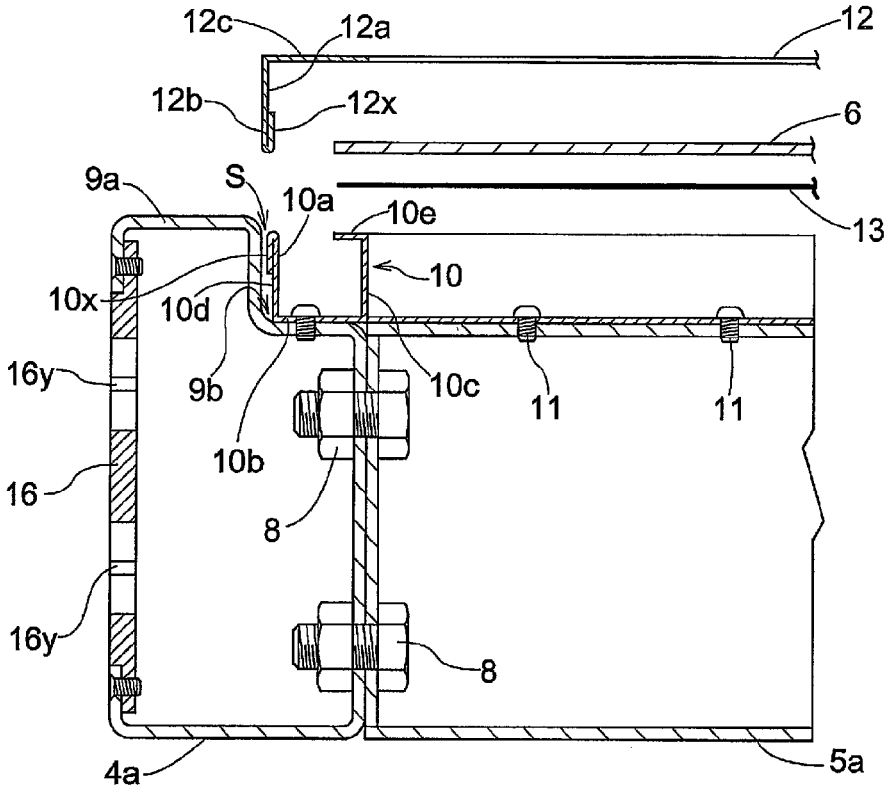
FIGS. 4A and 4B are enlarged cross-sectional views showing the wall panel mounting structure in the first embodiment.
Figure 4B:
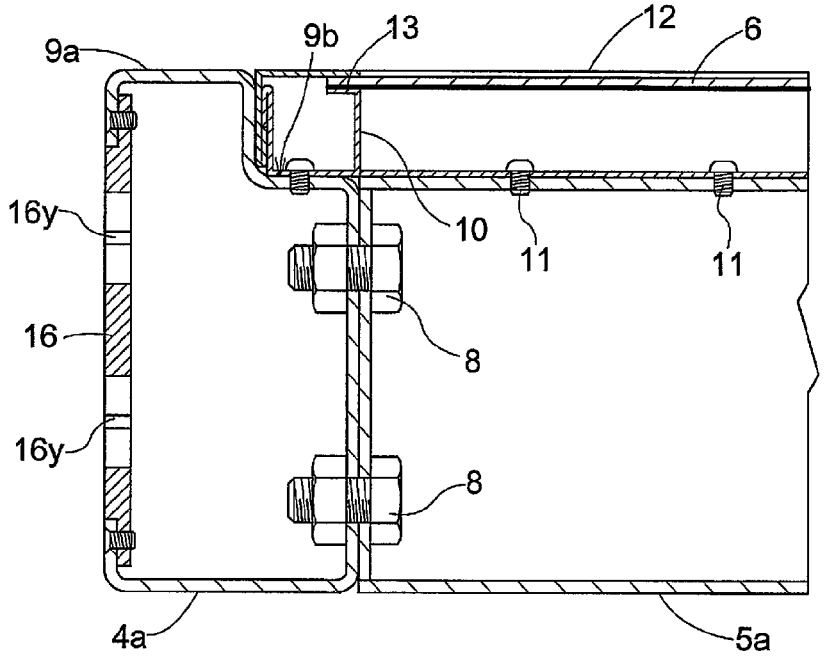
Figure 5:
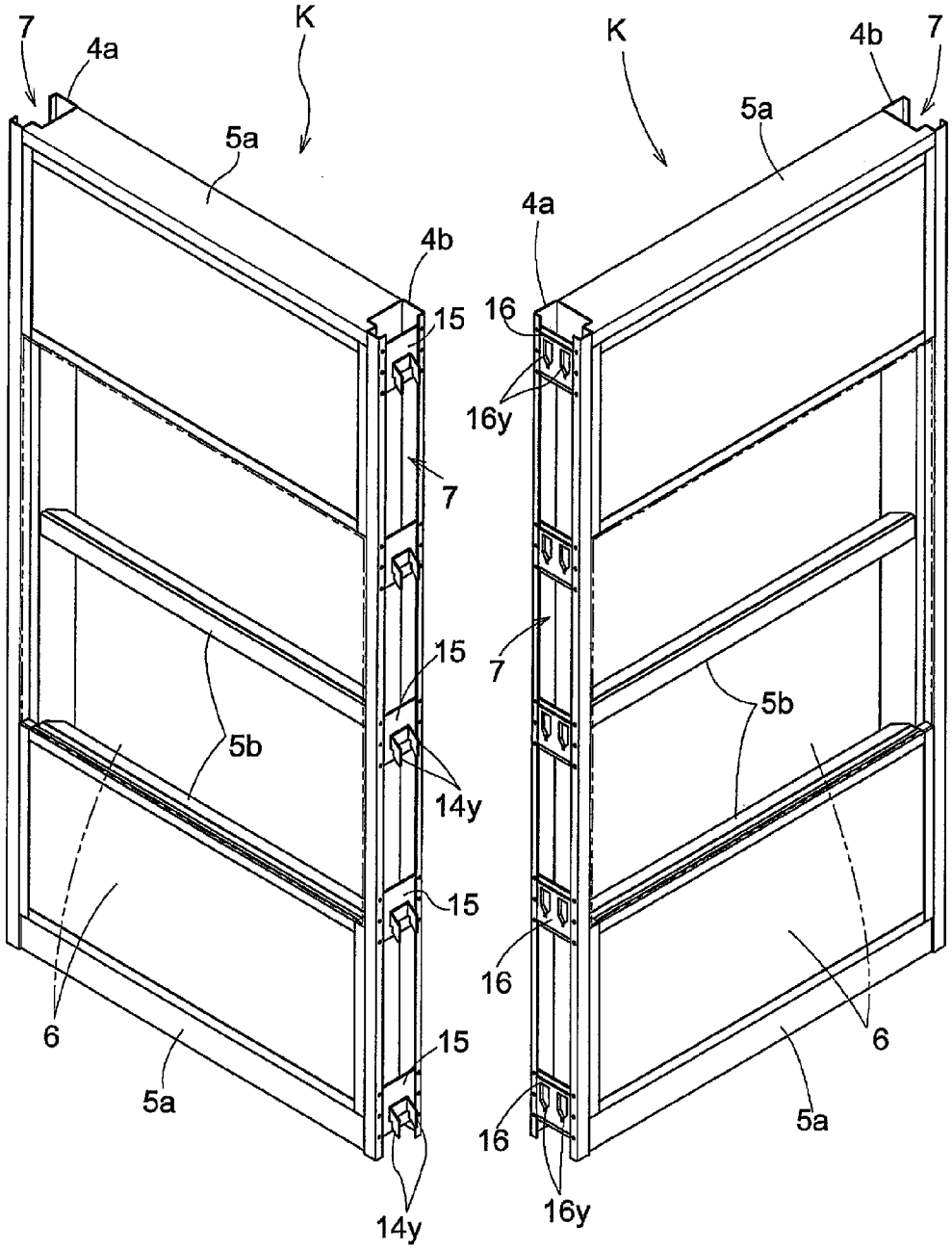
FIG. 5 is a perspective view showing a frame coupling structure in the first embodiment.
Figure 6A:
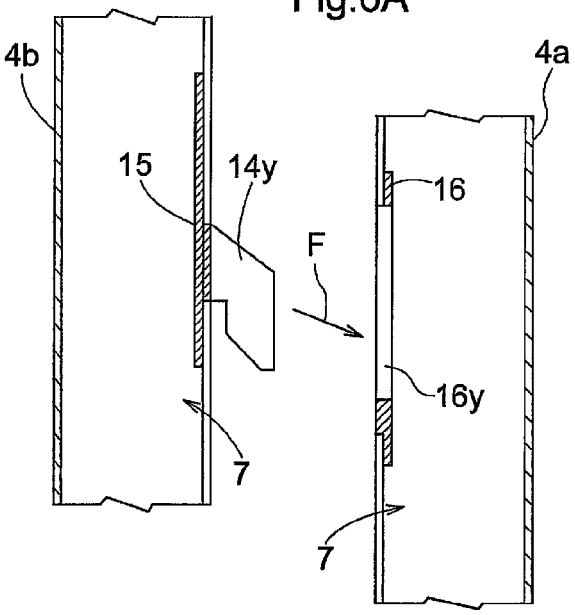
FIGS. 6A and 6B are cross-sectional views illustrating a frame coupling process in the first embodiment.
Figure 6B:
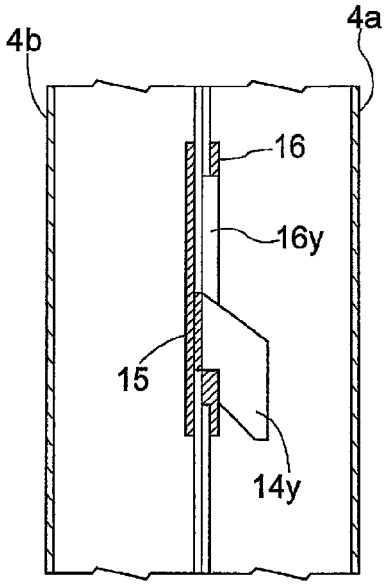
Figure 7:
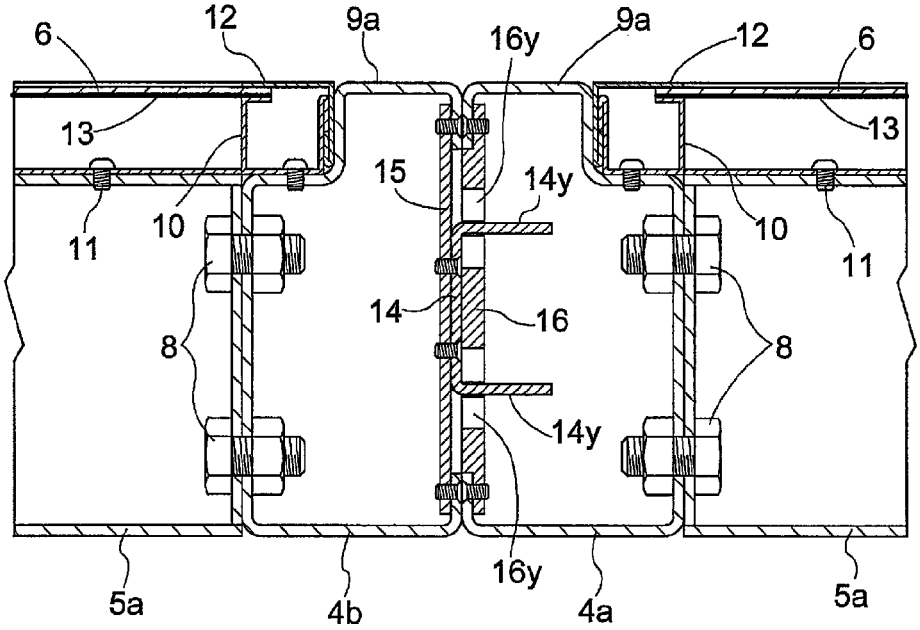
FIG. 7 is an enlarged cross-sectional view showing the frame coupling structure in the first embodiment.

As shown in FIG. 4, the main framing member 4*a*,4*b* has a bulging portion 9*a* on one side next to the side with the opening 7, at a position closer to the opening 7.

In addition, the main framing member 4*a*,4*b* has a recess portion 9*b* next to the bulging portion 9*a* (i.e., opposite to the opening 7 relative to the bulging portion 9*a*) as a sectional view.

Each of the bridging framing member 5*a* and the reinforcing framing member 5*b* is connected with the main framing members 4*a* and 4*b* in such a manner that one side face of each of the members 5*a* and 5*b* and a recessed face of the recess portion 9*b* of the main framing members 4*a* and 4*b* are in the same plane.

The ladder-like frame structure H includes: a sub-frame h defined by portions of the front main framing member 4*a*, the rear main framing member 4*b*, the bridging framing member 5*a* and the reinforcing framing member 5*b*; and the sub-frame h defined by portions of the front main framing member 4*a*, the rear main framing member 4*b* and the two reinforcing framing members 5*b*.

To an inner periphery of each of the sub-frame h is attached a rectangular frame 10 made of a frame bar 10*a* which is bent to become hollow.

Specifically, the rectangular frame 10 is fitted into the recess portion 9*b* in one side face of the main framing member 4*a*,4*b*. Then, the rectangular frame 10 is connected to one side face of each of the main framing members 4*a*,4*b*, the bridging framing member 5*a* and the reinforcing framing member 5*b*, by screws 11 provided in the hollow space of the frame bar 10*a*.

The frame bar 10*a* forming the rectangular frame 10 is a bent member formed by bending processing so as to have, as a sectional view, a mounting face 10*b* corresponding to one side face of each of the framing members 4*a*,4*b*,5*a*,5*b*; an inner face 10*c* defining an inner periphery of the rectangular frame 10; and an outer face 10*d* defining an outer periphery of the rectangular frame 10.

In an end edge portion of the inner face 10*c* of the frame bar 10*a*, a panel receiving face 10*e* is formed by bending processing.

When the rectangular frame 10 is attached, a gap is created between a side face portion of the bulging portion 9*a* of the main framing member 4*a*,4*b* and the outer face 10*d* of the frame bar 10*a*. This gap serves as a slit S for attaching a holder.

In other words, the rectangular frame 10 serves as a member for forming a slit S and the panel receiving face 10*e*, and by attaching the rectangular frame 10, one side face of the main framing member 4*a*,4*b* is provided with the slit S for attaching the holder and the panel receiving face 10*e* for mounting the wall panel 6, both of which extend in a longitudinal direction of the main framing members.

With respect to the mounting of the wall panel 6 to the ladder-like frame structure H, a holder 12 is provided which has approximately the same size as that of the rectangular frame 10.

By pinching an edge portion of the wall panel 6 between the holder 12 and the rectangular frame 10, the wall panel 6 can be mounted in each of the sub-frames h of the ladder-like frame structure H.

The holder 12 is formed of a bent member 12*a* having an L-shaped section with one side of the L-shape functioning as an insertion piece 12*b* to be inserted into the slit S and with other side of the L-shape functioning as a pinching piece 12*c* for pinching the edge portion of the wall panel 6.

In addition, in an end edge portion of the insertion piece 12*b* of the bent member 12*a*, a fold back portion 12*x* as a detachment prevention engaging portion is formed by folding inward of the L-shape.

On the other hand, in an end edge portion of the outer face 10*d* of the frame bar 10*a* forming the rectangular frame 10, a fold back portion 10*x* as a detachment prevention engaged portion is formed by folding the portion to a slit S side.

In other words, upon mounting the wall panel 6, the edge portion of the wall panel 6 is positioned over the panel receiving face 10*e* of the rectangular frame 10. In this state, the insertion piece 12*b* of the holder 12 is inserted into the slit S by an attaching operation of the holder 12 from outside the wall panel 6.

Along with this insertion, the fold back portion 12*x* of the insertion piece 12*b* and the fold back portion 10*x* of the rectangular frame 10 are engaged. With this engagement, the holder 12 is attached and fixed to each of the sub-frames h of the ladder-like frame structure H.

In addition, along with this insertion, a pinching action of the pinching piece 12*c* of the holder 12 is exerted on the edge portion of the wall panel 6, and by pinching the panel edge portion between the pinching piece 12*c* of the holder 12 and the panel receiving face 10*e* of the rectangular frame 10, the wall panel 6 can be mounted on and fixed to each of the sub-frame h of the ladder-like frame structure H.

To put it another way, the fold back portion 12*x* of the insertion piece 12*b* of the holder 12 and the fold back portion 10*x* of the outer face 10*d* of the rectangular frame 10 together make up a detachment prevention mechanism configured to exert an action of preventing the insertion piece 12*b* of the holder 12 from being detached, by engaging the fold back portions 10*x* and 12*x* with each other along with the insertion of the insertion piece 12*b* of the holder 12 into the slit S.

It should be noted that, by the above-described fixation structure utilizing the pinching by the holder 12, there can be used a panel material prepared by simple cutting of the plate member (i.e., panel material having cut edges with no trimming), as the wall panel 6.

Upon mounting the wall panel 6 as described above, a sealing member 13 is also disposed between the panel receiving face 10*e* of the rectangular frame 10 and the edge portion of the wall panel 6 mounted thereon.

When the sealing member 13 together with the edge portion of the wall panel 6 is pinched, high airtightness can be obtained.

For the sealing member 13, a double-faced tape type member with adhesive layers on both sides can be used. With the use of this member, the fixation of the wall panel 6 is supported and the airtightness is further enhanced.

Among the sub-frames h in the ladder-like frame structure H, a desired sub-frame h may be provided with a window framing member instead of the wall panel 6 so that a window is formed.

The gate-shaped modules 2, each formed of the wall structures K (the side walls 2*a* and the ceiling wall 2*b*) having the configuration as described above, are manufactured at a workplace separate from the construction site of the paint booth 1. Then, the gate-shaped modules 2 are carried to the construction site of the paint booth 1 and connected as described above, to thereby construct the paint booth 1.

Upon connecting the gate-shaped modules 2, a front side of the gate-shaped module 2 already installed is approached by another newly installed gate-shaped module 2 moving obliquely downward toward the rear.

With this approaching movement, the newly installed gate-shaped module 2 on a front side can be automatically connected and fixed to the previously installed gate-shaped module 2 on a rear side.

Specifically, as shown in FIGS. 4-7, among the main framing members 4*a*,4*b* included in the front gate-shaped module 2 newly installed, the main framing member 4*b* is positioned on the rear side. To a rear face portion (in which the opening 7 is formed) of this main framing member 4*b*, a plurality of bent pieces 14 each having a pair of right and left hook-shaped members 14*y* extending obliquely downward toward the rear are attached at predetermined intervals, through respective attachment plates 15.

On the other hand, among the main framing members 4*a*,4*b* included in the rear gate-shaped module 2 already installed, the main frame 4*a* is positioned on the front side. To a front face portion (in which the opening 7 is formed) of this main framing member 4*a*, a plurality of plate members 16 each having a pair of right and left downward-tapered holes 16*y* Banned therein are attached at predetermined intervals.

In other words, by moving the newly installed front gate-shaped module 2 obliquely downward toward the rear gate-shaped module 2 already installed, the rear main framing member 4*b* of the front gate-shaped module 2 is moved obliquely downward to the rear (direction of an arrow F in FIG. 6), in such a manner that the rear main framing member 4*b* faces the front main framing member 4*a* of the rear gate-shaped module 2.

Along with this approaching movement, the hook-shaped member 14*y* as a coupling engaging portion is engaged with the downward-tapered hole 16*y* as a coupling engaged portion.

With this engagement, the rear main framing member 4*b* of the front gate-shaped module 2 and the front main framing member 4*a* of the rear gate-shaped module 2 are closely connected with the framing members opposed to each other. With this configuration, the front gate-shaped module 2 newly installed is connected to the rear gate-shaped module 2 already installed.

To put it another way, the hook-shaped member 14*y* and the downward-tapered hole 16*y* make up a coupling mechanism configured to closely connect the two main framing members 4*a* and 4*b* together, by exerting a connection action as the main framing members 4*a* and 4*b* are moved relatively toward each other along a predetermined approaching pathway while retaining a state in which outer faces of the two main framing members 4*a* and 4*b* are opposed to each other so that the wall panels 6 mounted on the two main framing members 4*a* and 4*b* extend in opposite directions from the two main framing members 4*a* and 4*b*.

In addition, since the downward-tapered hole 16*y* as coupling engaged portion has an upper portion with a wider width and a lower portion tapering downward, in the above-described approaching movement of the two main framing members 4*a* and 4*b*, even though the two main framing members 4*a* and 4*b* are displaced to some extent, the hook-shaped member 14*y* is guided so as to be received by the upper wider portion of the downward-tapered hole 16*y*.

Afterward, as the engagement proceeds, the hook-shaped member 14*y* is guided along the lower narrower portion of the downward-tapered hole 16*y*, to thereby connect the two main framing members 4*a* and 4*b* in a predetermined positional relationship with high accuracy.

To sum up, in the present embodiment, the wall structure K is formed by mounting the wall panels 6 on the two front and rear main framing members 4*a* and 4*b* arranged in parallel and fixing the wall panels 6 thereto using the respective holders 12.

In addition, with a pair of the right and left upright wall structures K (i.e., wall structures forming the side walls 2*a*), the transverse wall structure K (i.e., wall structure forming the ceiling wall 2*b*) is connected so as to bridge the upright wall structures K, to thereby form the gate-shaped module 2.

Then, with respect the two gate-shaped modules 2 arranged adjacently in the front-rear direction, the rear main framing member 4*b* in the front gate-shaped module 2 and the front main framing member 4*a* in the rear gate-shaped module 2 are coupled through the coupling mechanism. In this manner, a plurality of the gate-shaped modules 2 arranged in the front-rear direction are connected, to thereby build the paint booth 1.

Other embodiments of the present invention will be described below. In the first embodiment, in order to provide the slit S for attaching the holder to one side face of the framing members 4*a*,4*b* (main framing member), the bulging portion 9*a* is formed so as to bulge from one side face of the framing member 4*a*,4*b*, the frame bar 10*a* of the rectangular frame 10 is attached to the framing member 4*a*,4*b* at the position adjacent to the bulging portion 9*a*, and the gap created between the bulging portion 9*a* and the frame bar 10*a* is used as the slit S for attaching the holder.

Figure 8:
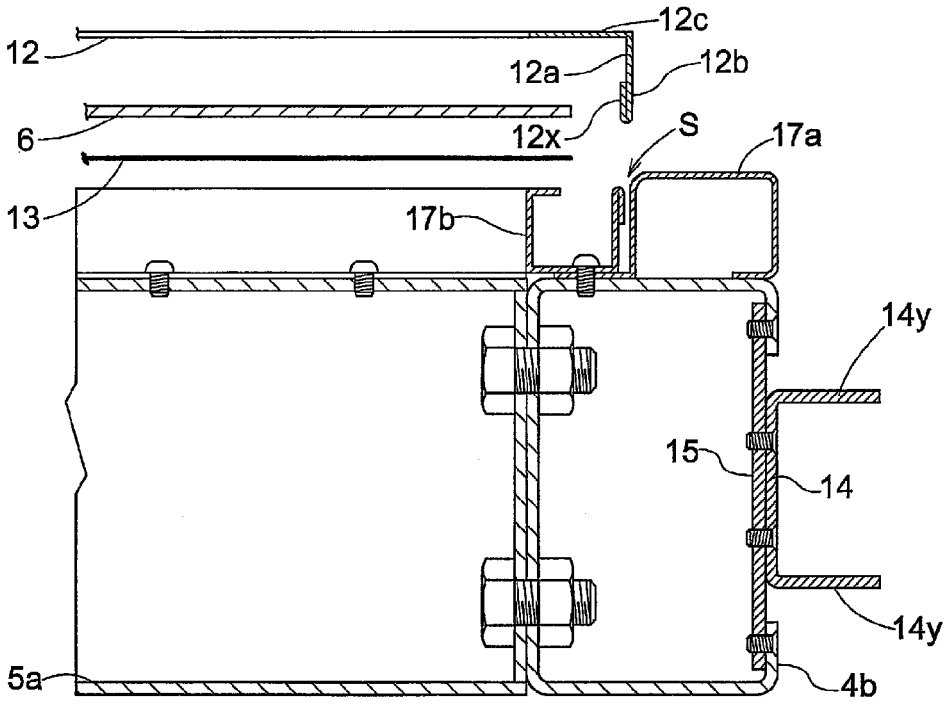
FIG. 8 is an enlarged cross-sectional view showing another embodiment.

However, the configuration of the slit S for attaching the holder formed in one side face of the framing member 4*a*,4*b* is not limited to those in the first embodiment, and alternatively, for example as shown in FIG. 8, a slit-foaming member 17*a* corresponding to the bulging portion 9*a* and a slit-forming member 17*b* corresponding to the frame bar 10*a* are attached to one side face of the framing member 4*a*,4*b*, and a gap formed between the slit-forming members 17*a*, 17*b* can be used as the slit S for attaching the holder.

Figure 9:
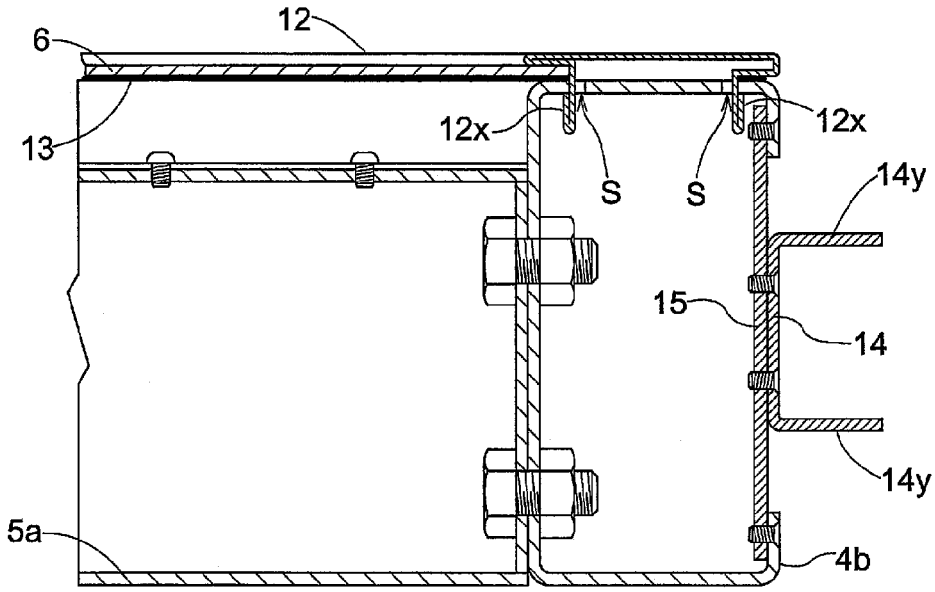
FIG. 9 is an enlarged cross-sectional view showing still another embodiment.
Figure 10:
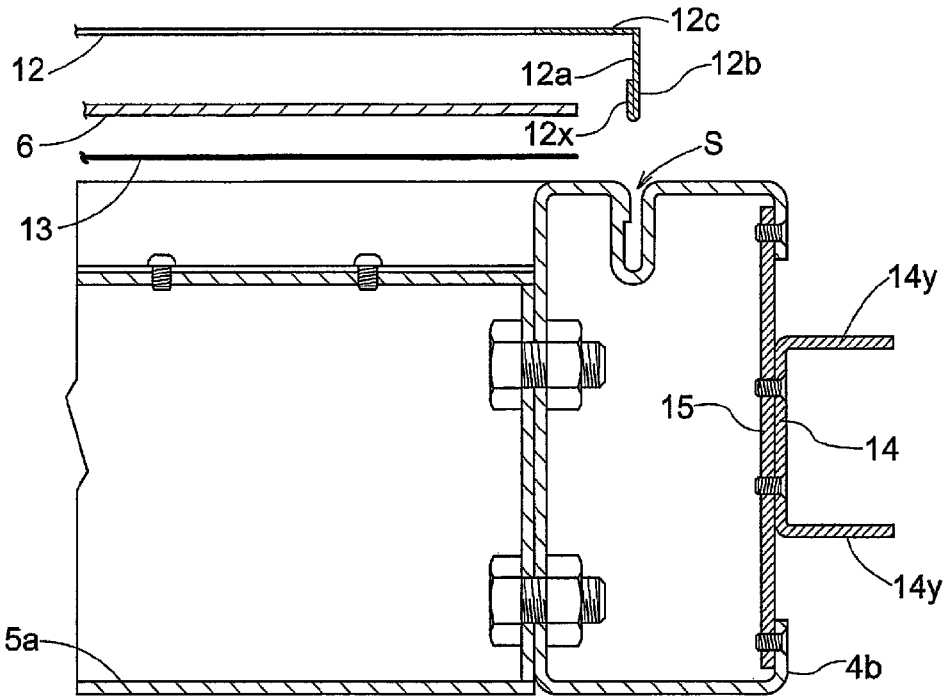
FIG. 10 is an enlarged cross-sectional view showing yet another embodiment.

Alternatively, the slit S for attaching the holder may be formed in one side face of the framing member 4*a*,4*b* by molding the hollow frame member 4*a*,4*b*, or by cutting out one side face of the framing member 4*a*,4*b*, in such a manner that a cross-sectional shape thereof becomes those as shown in FIGS. 9 and 10.

Other than the above, upon carrying out the present invention, various configurational modifications are possible with respect to the structure of the slit S for attaching the holder formed in one side face of the framing member 4*a*,4*b*.

The slit S for attaching the holder, which slit extends in a longitudinal direction of the framing member 4*a*,4*b*, may be provided contiguously along the entire length of the framing member 4*a*,4*b*, or alternatively, may be provided intermittently.

The structure of the holder 12 having the insertion piece 12*b* and the pinching piece 12*c* is not limited to the above-described rectangular frame structure, and various configurational modifications are possible.

For example, the holder 12 may have a linear structure, such as one side of the above-described rectangular frame structure as a single piece. In addition, the holder 12 may be those obtained by dividing such one side piece.

The cross section of the holder 12 is not limited to the L-shape described above.

In the first embodiment, the detachment prevention mechanism is made up of the fold back portion 12*x* provided in the insertion piece 12*b* of the holder 12 and the fold back portion 10*x* provided in the rectangular frame 10. Alternatively, various configurational modifications are possible with respect to the specific structure of the detachment prevention mechanism configured to exert an action of preventing the insertion piece 12*b* from being detached, along with the insertion of the insertion piece 12*b* into the slit S for attaching the holder.

In the first embodiment, the structure provided with a pair of the hook-shaped members 14*y* and a pair of the downward-tapered holes 16*y* was described, as the coupling engaging portion and the coupling engaged portion for connecting the two framing members 4*a* and 4*b*. Alternatively, various configurational modifications are possible with respect to the coupling engaging portion and the coupling engaged portion.

Figure 11:
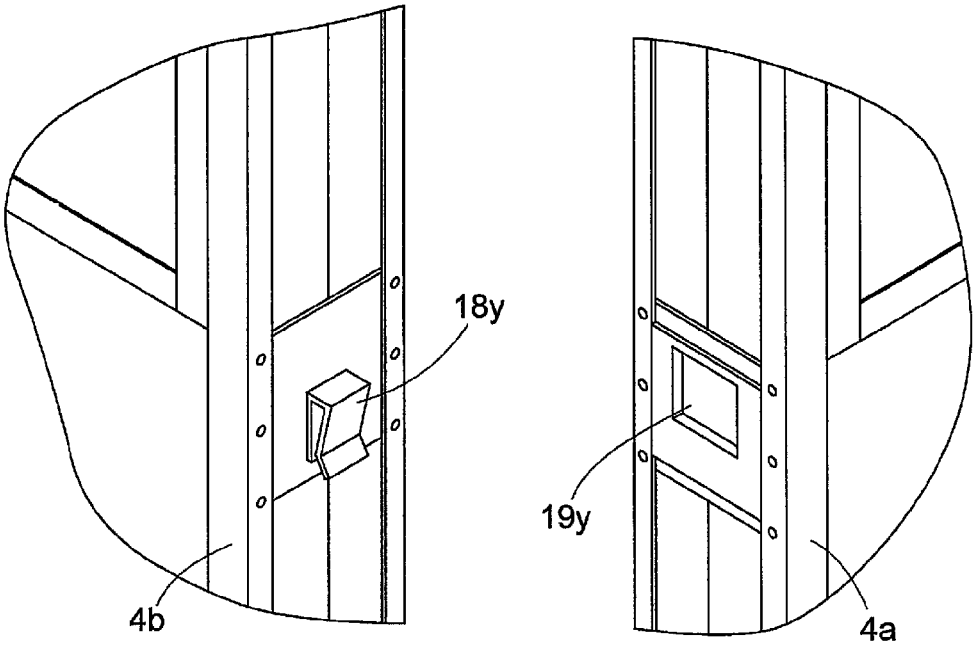
FIG. 11 is a perspective view showing further embodiment.
Figure 12A:
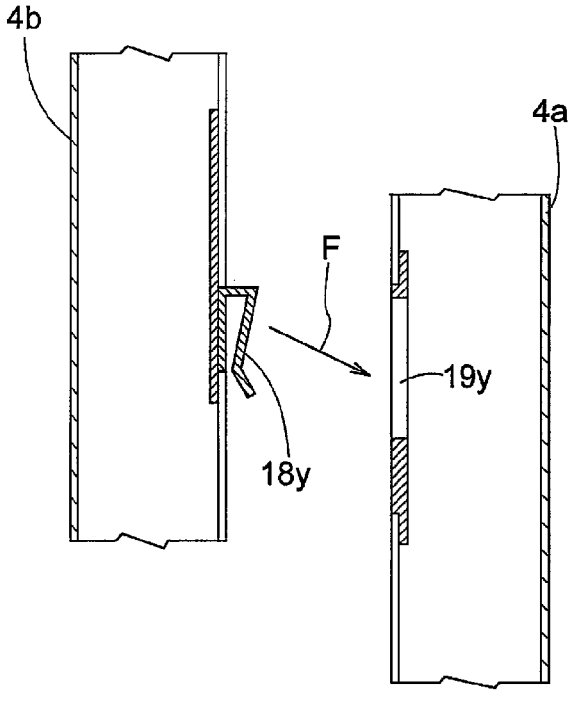
FIGS. 12A and 12B are cross-sectional views showing further embodiment.
Figure 12B:
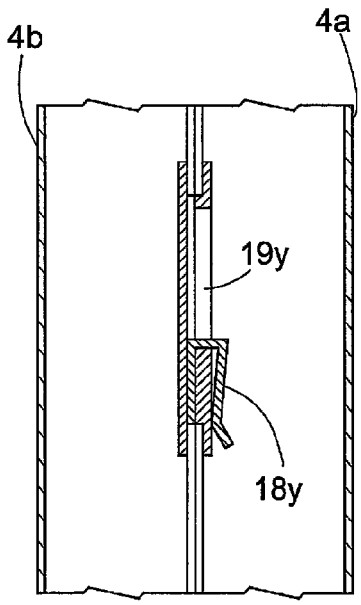

For instance, as shown in FIGS. 11 and 12, a clip-shaped member 18*y* may be used as a coupling engaging portion and a rectangular hole 19*y* may be used as a coupling engaged portion whose edge is bit by the clip-shaped member 18*y*.

In addition, with respect to the coupling mechanism that is configured to closely connect the two framing members 4*a* and 4*b* in a state in which outer faces of the framing members 4*a* and 4*b* are opposed to each other, by exerting a connection action as the framing members 4*a* and 4*b* are moved relatively toward each other along a predetermined approaching pathway while retaining a state in which outer faces of the two framing members 4*a* and 4*b* are opposed to each other so that the wall panels 6 mounted on the two framing members 4*a* and 4*b* extend in opposite directions from the two framing members 4*a* and 4*b*, the specific configuration is not limited to the hook type engagement structure and clip type engagement structure as described above, and various configurational modification are possible.

Figure 13:
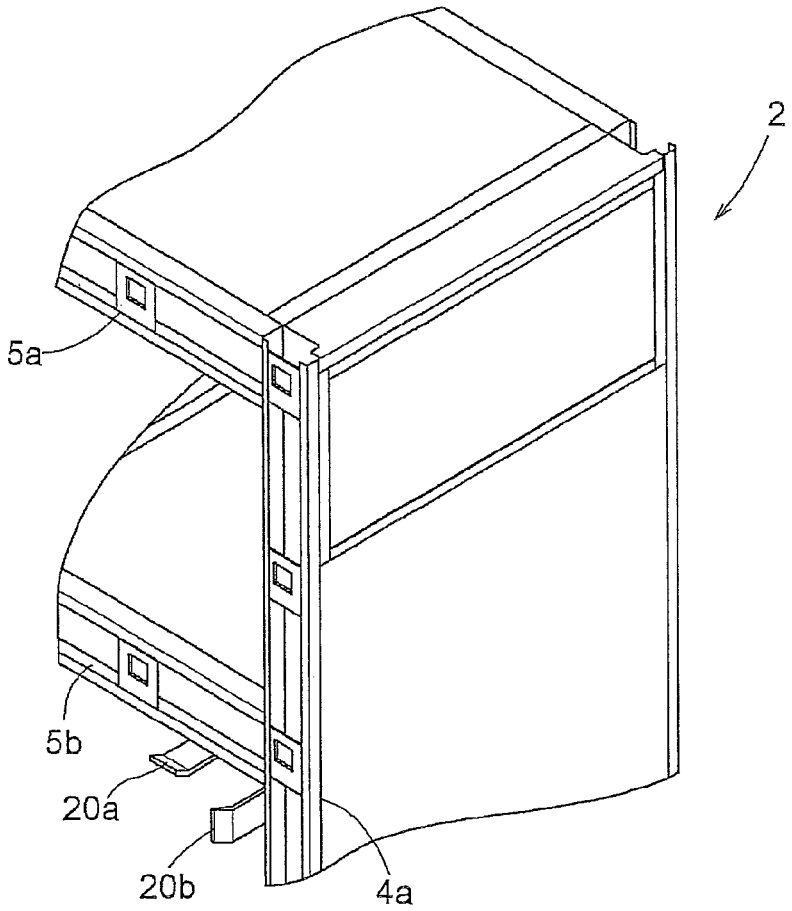
FIG. 13 is a perspective view showing still further embodiment.
Figure 14:
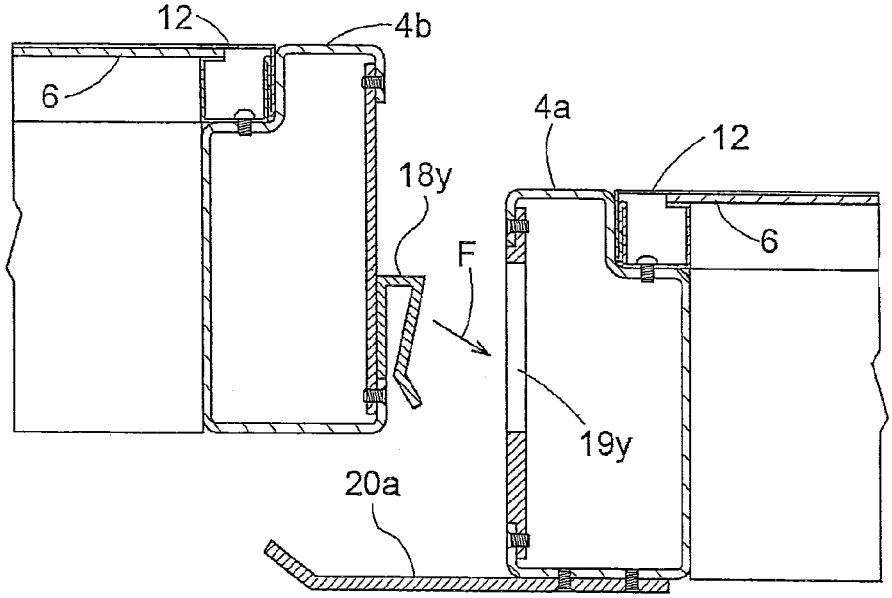
FIG. 14 is an enlarged cross-sectional view showing still further embodiment.
Figure 15A:
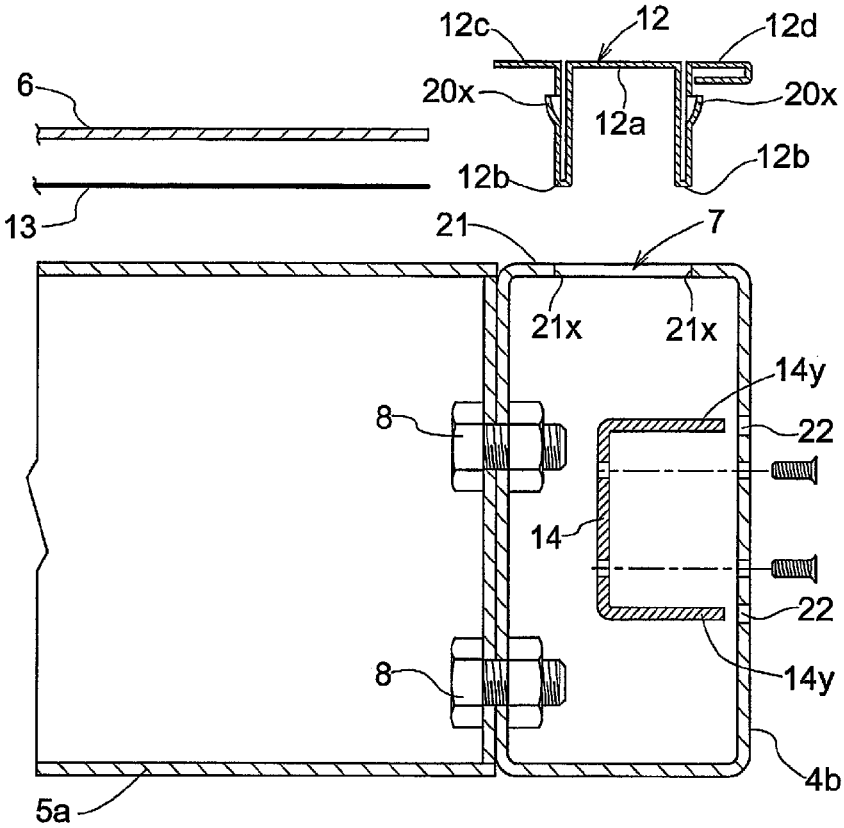
FIGS. 15A and 15B are enlarged cross-sectional views showing a wall panel mounting structure in a second embodiment.
Figure 15B:
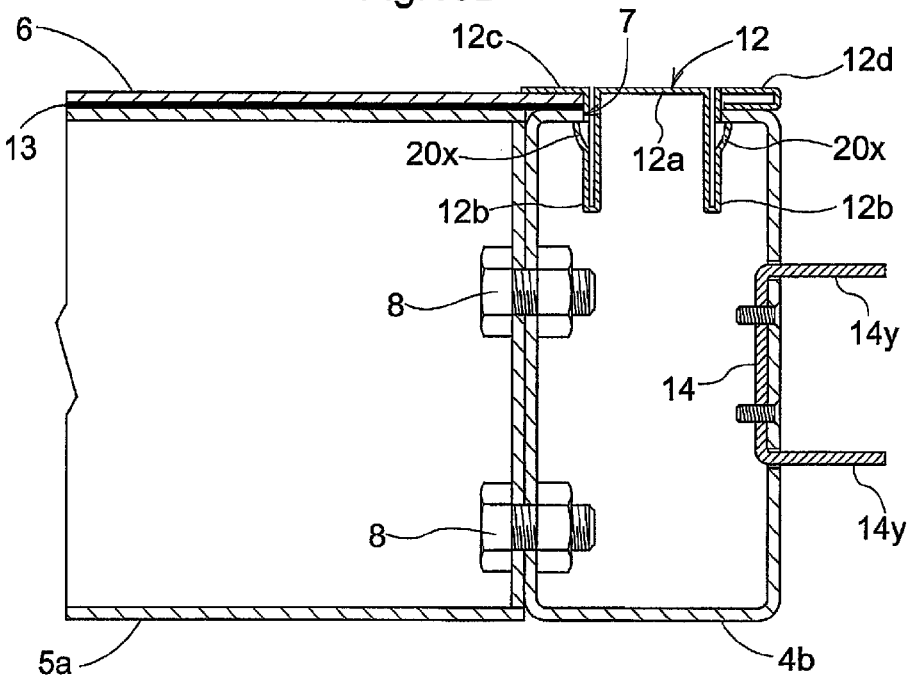
Figure 16:
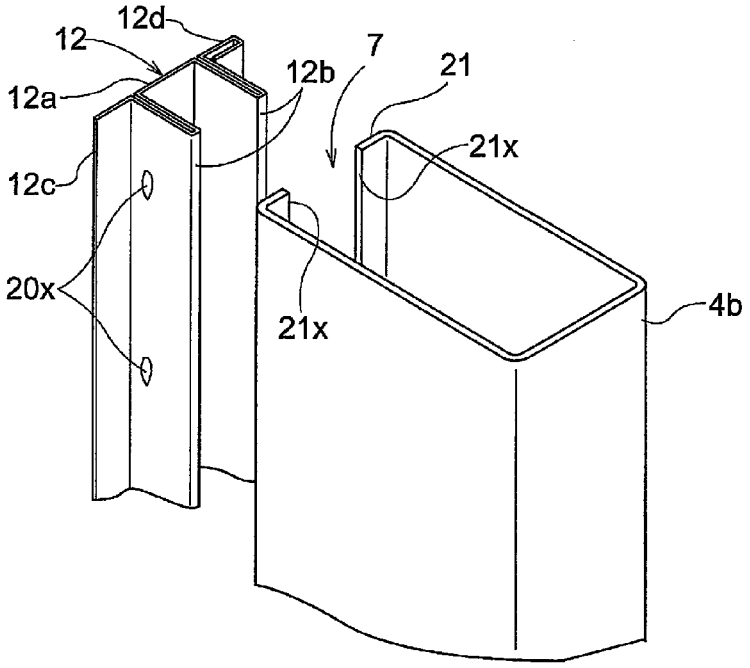
FIG. 16 is a perspective view showing the wall panel mounting structure in the second embodiment.
Figure 17:
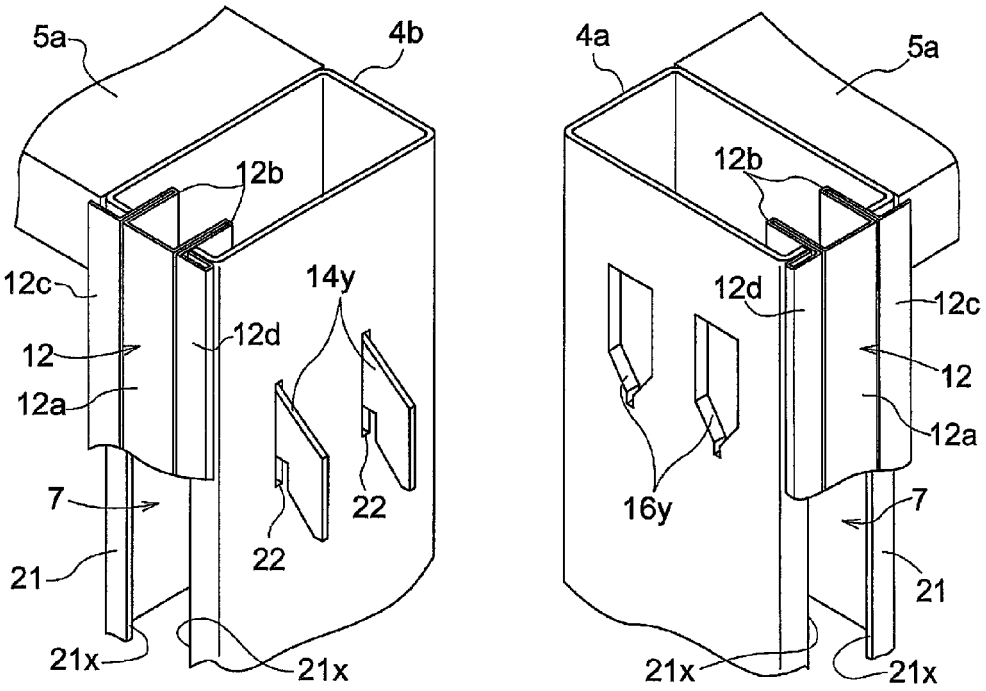
FIG. 17 is a perspective view showing a frame coupling structure in the second embodiment.
Figure 18:
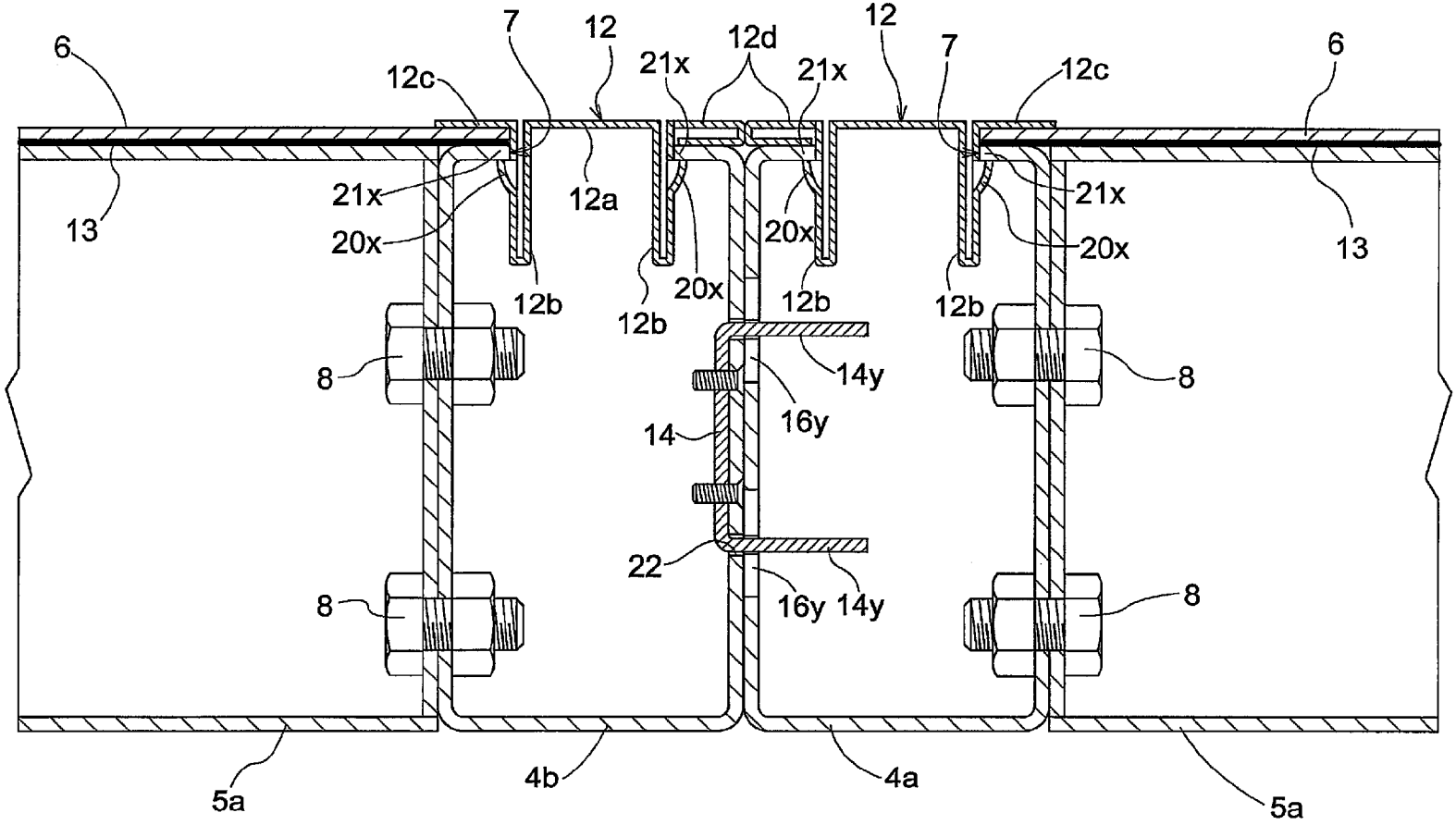
FIG. 18 is an enlarged cross-sectional view showing a wall panel mounting state and a frame coupling state in the second embodiment.
Figure 19:
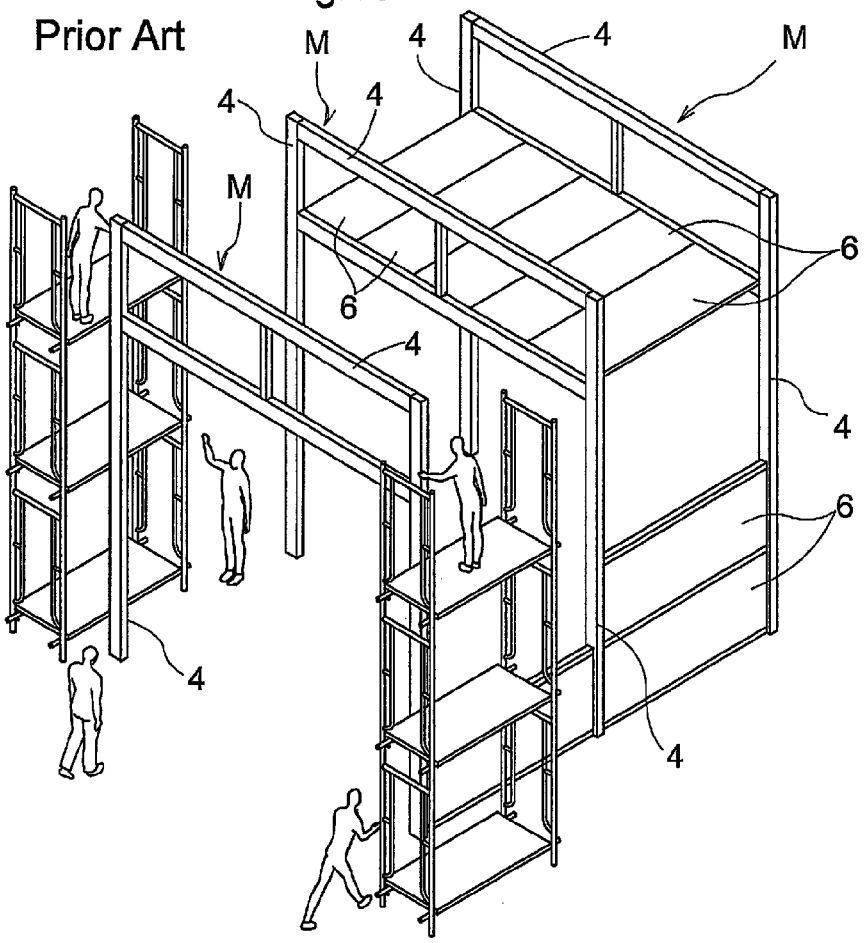
Fig.19 Prior Art
FIG. 19 is a perspective view showing the prior art.
Figure 20:
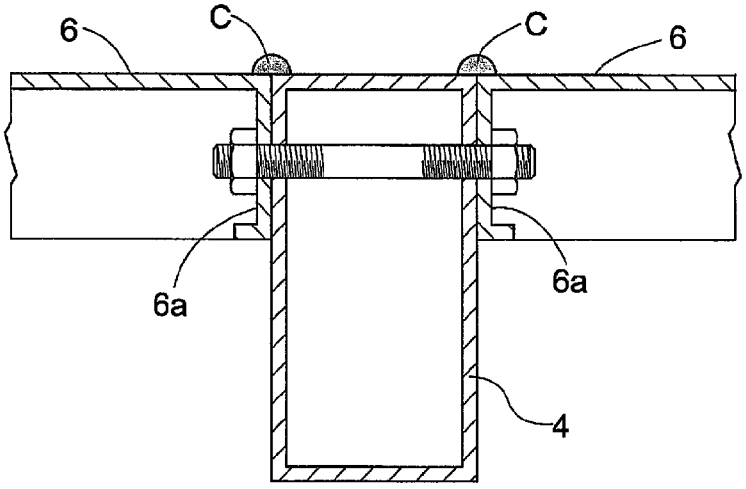
Fig.20 Prior Art
FIG. 20 is an enlarged cross-sectional view showing the prior art.

In the first embodiment, during the approaching movement of the two framing members 4*a* and 4*b* in the connection thereof, a positional displacement of the two framing members 4*a* and 4*b* is corrected utilizing the shape of the downward-tapered hole 16*y* as coupling engaged portion. Instead of this, or in combination with this, as shown in FIGS. 13 and 14, at least one of the two framing members 4*a* and 4*b* may be provided with a horizontal guide member 20*a* configured to guide the approaching movement of the two framing members 4*a* and 4*b* in a horizontal direction, or a vertical guide member 20*b* configured to guide the movement in a vertical direction.

Second Embodiment

FIGS. 15-18 show a factory building assembly structure according to a second embodiment which is a modified version of the factory building assembly structure according to the first embodiment.

In the factory building assembly structure of the second embodiment, C type steel is used as the main framing member 4*a*,4*b* in the above-described ladder-like frame structure H, and the opening 7 in the C-shaped section of the C type steel 4*a*,4*b* is used as the slit S for attaching the holder which slit extends in the longitudinal direction of the framing member.

On the other hand, the holder 12 is provided with two ridges of the insertion pieces 12*b* arranged in parallel with an interval which is approximately the same as an opening width of the slit S (opening 7).

In the holder 12, the pinching piece 12*c* perpendicular to the insertion piece 12*b* as a sectional view is formed outward from one of the insertion piece 12*b*, and an auxiliary piece 12*d* perpendicular to the insertion piece 12*b* as a sectional view is formed outward from the other of the insertion piece 12*b*.

These two ridges of the insertion pieces 12*b*, the pinching piece 12*c*, and the auxiliary piece 12*d* extend in a longitudinal direction of the holder 12 (i.e., the longitudinal direction of the main framing member 4*a*,4*b* made of C type steel), contiguously or intermittently.

In addition, the holder 12 is the bent member 12*a* formed by bending processing so as to have these two ridges of the insertion pieces 12*b*, the pinching piece 12*c* and the auxiliary piece 12*d*, as bent portions in a single member, like in the first embodiment.

On an outer face of each of the insertion pieces 12*b*, protrusions 20*x* are arranged in the longitudinal direction of the holder 12. The protrusions 20*x* serve as detachment prevention engaging portions on the holder 12.

In other words, in the factory building assembly structure of the second embodiment, upon mounting the wall panel 6, a face 21 surrounding the slit S (opening 7) in the main framing member 4*a*,4*b* (C type steel) is used as panel receiving face, and the edge portion of the wall panel 6 is positioned over the panel receiving face 21.

In this state, two ridges of the insertion piece 12*b* of the holder 12 are simultaneously inserted into the slit S (opening 7) by an attaching operation of the holder 12 from outside the wall panel 6.

Along with this insertion, each of the protrusions 20*x* provided outside of the insertion piece 12*b* is engaged with an edge portion 21*x* of the slit S (opening 7) in the main framing member 4*a*,4*b* (C type steel). With this engagement, the holder 12 is attached and fixed to the ladder-like frame structure H.

In addition, along with this insertion, a pinching action of the pinching piece 12*c* of the holder 12 is exerted on the edge portion of the wall panel 6, and by pinching the panel edge portion between the pinching piece 12*c* of the holder 12 and the panel receiving face 21 of the main framing member 4*a*,4*b*, the wall panel 6 can be mounted on and fixed to the ladder-like frame structure H.

In other words, the protrusions 20*x* provided on the outer face of each of the insertion pieces 12*b* and the edge portion

21$x$ of the slit S (opening 7) in the main framing member 4$a$,4$b$ together make up the detachment prevention mechanism configured to exert an action of preventing the insertion piece 12$b$ of the holder 12 from being detached, by engaging the protrusion 20$x$ and the edge portion 21$x$ with each other along with the insertion of the insertion piece 12$b$ of the holder 12 into the slit S.

In the factory building assembly structure of the second embodiment, the opening 7 in the C-shaped section of the C type steel 4$a$,4$b$ is utilized as the slit S, and therefore time and effort required for post-processing can be omitted as compared with the case where the silt is formed by post-processing in the steel to be used as a framing member.

In addition, by utilizing elastic deformation in approaching-separating directions (in other words, elastic deformation in a direction of an opening width of the slit S) of the two ridges of the insertion pieces 12$b$ provided in the holder 12, the fixation of the holder 12 and the wall panel 6 to the framing member 4$a$,4$b$, by inserting the two ridges of the insertion pieces 12$b$ into the slit S, can be facilitated. Moreover, the fixation strength can be enhanced.

For the connection at a construction site of the gate-shaped modules 2 formed of the wall structures K in which the wall panel 6 is mounted on the ladder-like frame structure H as described above to construct the paint booth 1, like in the first embodiment, the coupling mechanism is made up of the hook-shaped member 14$y$ and the downward-tapered hole 16$y$ for engaging with the hook-shaped member 14$y$, which are configured to closely connect the two main framing members 4$a$ and 4$b$ together in a state in which outer faces of the main framing members 4$a$ and 4$b$ are opposed to each other.

However, in the factory building assembly structure of the second embodiment, the opening 7 of the C type steel as the main framing member 4$a$,4$b$ is used as the slit S for attaching the holder, and therefore, the bent piece 14 having a pair of the right and left hook-shaped members 14$y$ is attached from inside the C-shaped section of the main framing member 4$b$ to a rear face portion (in which the opening 7 is not present) of the main framing member 4$b$ so as to position the bent piece 14 on the rear side of the gate-shaped module 2. In this attachment, the hook-shaped member 14$y$ protrudes rearward from the main framing member 4$b$, through a through-hole 22 formed in the rear face portion of the main framing member 4$b$.

In addition, the downward-tapered hole 16$y$ is directly formed by cutting a front face portion (having no opening 7) of the main framing member 4$a$ which is located on the front side of the gate-shaped module 2.

The assembling procedure to construct the paint booth 1, by sequentially connecting the gate-shaped modules 2 using the coupling mechanism, is the same as that described for the first embodiment.

In the second embodiment, the opening 7 in the C-shaped section of the C type steel 4$a$,4$b$ as framing member serves as the slit S for attaching the holder, and two ridges of the insertion pieces 12$b$ of the holder 12 are inserted into the slit S. In another embodiment of the present invention, instead of this structure, the slit S into which two ridges of the insertion piece 12$b$ of the holder 12 are inserted may be formed in the framing member 4$a$,4$b$, by cutting processing, attachment of a member for providing a slit, or the like.

In addition, as shown in FIG. 9, two separate slits S for inserting the respective two ridges of the insertion pieces 12$b$ may be formed in the framing member 4$a$,4$b$.

On the other hand, in the case where the opening 7 in the C-shaped section of the C type steel 4$a$,4$b$ is utilized as the slit S for attaching the holder, the insertion piece 12$b$ inserted into the slit S may be a broader single insertion piece, instead of the above-described two ridges of the insertion pieces.

In an modified embodiment of the second embodiment, the auxiliary piece 12$d$ provided in the holder 12 is used as the pinching piece 12$c$, and thus two pinching pieces 12$c$ are arranged on both sides of the insertion pieces 12$b$ of the holder 12, and two different wall panels 6 may be fixed to the framing member 4$a$,4$b$, using the respective pinching pieces 12$c$.

The factory building assembly structure according to the present invention and the method for assembling a factory building using the same are applicable to assembling of not only paint booth, but also factory building of various applications.

The invention claimed is:

1. A factory building assembly structure, wherein a framing member forming a frame of a factory building is provided with a slit formed on the framing member for attaching a holder on one side face of the framing member, the slit extending in a longitudinal direction of the framing member, the slit is provided with a detachment prevention mechanism configured to exert an action of preventing an insertion piece of the holder from being detached and to fix the holder to the framing member, along with an insertion of the insertion piece into the slit, and the holder is formed with a pinching piece that presses an end edge portion of a wall panel between the pinching piece and the framing member to fix the wall panel against the framing member, along with the insertion of the insertion piece into the slit, wherein the detachment prevention mechanism comprises:

a detachment prevention engaging portion provided as a fold back portion on the insertion piece of the holder; and a detachment prevention engaged portion provided on the framing member, which is configured to prevent the insertion piece of the holder from being detached, by being engaged with the detachment prevention engaging portion along with an insertion of the insertion piece into the slit.

2. The factory building assembly structure according to claim 1, wherein the end edge portion of the wall panel is pinched between a panel receiving face of the framing member configured to receive the end edge portion of the wall panel and the pinching piece of the holder, while a sealing member is present between the end edge portion of the wall panel and the panel receiving face.

3. The factory building assembly structure according to claim 1, wherein the holder is provided with two ridges of the insertion piece arranged in parallel, and the slit has an opening width that allows simultaneous insertion of two ridges of the insertion piece of the holder.

4. The factory building assembly structure according to claim 1, wherein C type steel is used as the framing member and an opening in a C-shaped section of the C type steel is used as the slit.

5. The factory building assembly structure according to claim 1, wherein the holder is a bent member formed by bending processing so as to have the insertion piece and the pinching piece as bent portions.

6. The factory building assembly structure according to claim 1, wherein two pinching pieces are arranged on both sides of the insertion piece of the holder, and these two pinching pieces are configured to fix the respective wall panels to the framing member.

7. The factory building assembly structure according to claim 1, wherein a coupling mechanism is provided that is configured to connect two framing members, by exerting a connection action as the framing members are moved relatively toward each other along a predetermined approaching pathway while retaining a state in which outer faces of the framing members are opposed to each other so that the wall panel mounted on each framing member extends in an opposite direction from the framing members.

8. The factory building assembly structure according to claim 7, wherein the coupling mechanism comprises:

a coupling engaging portion provided on one of the two framing members; and a coupling engaged portion provided on the other of the two framing members, which is configured to be engaged with the coupling engaging portion to connect the two framing members in a state in which outer faces of the two framing members are opposed to each other, as the two framing members are moved relatively toward each other along a predetermined approaching pathway while retaining a state in which outer faces of the two framing members are opposed to each other.

9. The factory building assembly structure according to claim 7, wherein at least one of the two framing members is provided with a guide member configured to guide a relative approaching movement along a predetermined approaching pathway of the two framing members.

10. A method for assembling a factory building using a factory building assembly, the factory building assembly comprising:

a framing member forming a frame of a factory building is provided with a slit formed on the framing member for attaching a holder on one side face of the framing member, the slit extending in a longitudinal direction of the framing member, the slit is provided with a detachment prevention mechanism configured to exert an action of preventing an insertion piece of the holder from being detached and to fix the holder to the framing member, along with an insertion of the insertion piece into the slit, and the holder is formed with a pinching piece that presses an end edge portion of a wall panel between the pinching piece and the framing member to fix the wall panel against the framing member, along with the insertion of the insertion piece into the slit, wherein the detachment prevention mechanism comprises:

a detachment prevention engaging portion provided as a fold back portion on the insertion piece of the holder; and a detachment prevention engaged portion provided on the framing member, which is configured to prevent the insertion piece of the holder from being detached, by being engaged with the detachment prevention engaging portion along with an insertion of the insertion piece into the slit, and wherein a coupling mechanism is provided that is configured to connect two framing members, by exerting a connection action as the framing members are moved relatively toward each other along a predetermined approaching pathway while retaining a state in which outer faces of the framing members are opposed to each other so that the wall panel mounted on each framing member extends in an opposite direction from the framing members, the method comprising the steps of:

a step of forming a wall structure, in which the wall panel is fixed to the two framing members arranged in parallel in a front-rear direction using the holder in such a manner that the wall panel bridges the two framing members;

a step of forming a gate-shaped module, in which a transversal wall structure is connected to a pair of right and left upright wall structures in such a manner that the transversal wall structure bridges the right and left upright wall structures; and a step of constructing the factory building by connecting a plurality of the gate-shaped modules arranged in the front-rear direction, in which two gate-shaped modules arranged adjacently in the front-rear direction, with a rear side of one of the framing members adjacent a front side of the gate-shaped module and the front side of one of the framing members adjacent a rear side of the gate-shaped module, are connected with each other by the coupling mechanism.

* * * * *